United States Patent [19]

Lovell et al.

[11] Patent Number: 4,777,815

[45] Date of Patent: Oct. 18, 1988

[54] GROUP CARD-KEY ACTUATED LOCK HAVING INDIVIDUAL LOCKOUT

[75] Inventors: Walter C. Lovell, Wilbraham; Roger J. Kuhns, Lincoln, both of Mass.

[73] Assignee: Avant Incorporated, Concord, Mass.

[21] Appl. No.: 774,339

[22] Filed: Sep. 10, 1985

[51] Int. Cl.[4] ..... E05B 47/00

[52] U.S. Cl. ..... 70/276; 29/401.1; 70/384; 70/413

[58] Field of Search ..... 70/382, 276, 384, 413; 29/401.1

[56] References Cited

U.S. PATENT DOCUMENTS

| | | | |
|---|---|---|---|
| 428,247 | 5/1890 | Fenner | 70/276 |
| 1,084,502 | 1/1914 | Sullivan | 70/312 |
| 1,172,203 | 2/1916 | Fuller | 70/413 |
| 2,767,278 | 10/1956 | Collins | 70/276 |
| 3,175,379 | 3/1965 | Russell et al. | 70/384 |
| 3,271,983 | 9/1966 | Schlage | 70/276 |
| 3,348,392 | 10/1967 | Schreiber | 70/382 |
| 3,395,555 | 8/1968 | Hickman | 70/276 |
| 3,570,287 | 3/1971 | Hallmann | 70/276 |
| 3,681,727 | 8/1972 | Hallmann | 70/276 |
| 3,782,147 | 1/1974 | Hallmann | 70/276 |
| 3,837,193 | 9/1974 | Csurgay | 70/276 |
| 3,837,525 | 9/1974 | Kobayashi | 70/276 X |
| 3,857,262 | 12/1974 | Sidiropoulos | 70/276 |
| 4,149,394 | 4/1979 | Sornes | 70/386 X |
| 4,376,382 | 3/1983 | Raymond et al. | 70/384 X |

FOREIGN PATENT DOCUMENTS

| | | | |
|---|---|---|---|
| 1553544 | 7/1969 | Fed. Rep. of Germany | 70/276 |
| 2507599 | 9/1976 | Fed. Rep. of Germany | 70/276 |
| 2254976 | 7/1975 | France | 70/276 |
| 589207 | 6/1977 | Switzerland | 70/276 |
| 766126 | 1/1957 | United Kingdom | 70/384 |

*Primary Examiner*—Lloyd A. Gall

*Attorney, Agent, or Firm*—Robert L. Nathans; Douglas E. Denninger

[57] ABSTRACT

A number of bearers concurrently use card-keys, having a common access code, and a unique lockout code to open a single lock. If a particular bearer is to be selectively locked out, the lockout code sensing device in the lock is changed to lockout the particular bearer but not all other bearers concurrently using their card keys to open the same lock.

21 Claims, 5 Drawing Sheets

GROUP CARD-KEY ACTUATED LOCK HAVING INDIVIDUAL LOCKOUT

BACKGROUND OF THE INVENTION

The present invention relates to the field of card-key code responsive locks. In co-pending patent application No. 538,980, filed 10/04/83, filed in the name of Walter Lovell, and assigned to Avant Incorporated, a non-electrical lock (the Lovell lock) is provided having a first set of pivoted latching fingers having hook ends facing in a first direction, together with a second set of pivoted latching fingers interlaced with the first set in accordance with a particular combination, which unlocks the device. The fingers of the second set of latching fingers have hook ends facing in a direction opposite to the direction of orientiation of the hook ends of the first set, and actuation of only the proper combination of fingers causes the hooks of all fingers to be displaced away from the lock anchor members to unlock the Lovell lock. More specifically, if one or more fingers of the first finger set are not actuated, so that all of the fingers which are supposed to be actuated are not actuated, the hook of such finger(s) will remain engaged with a first anchor member and the lock will not open. On the other hand should one or more fingers of the second set be actuated, contrary to the proper combination, the oppositely facing hook portions thereof, which are normally disengaged from a second anchor member will become engaged with such second anchor member, to prevent the lock from opening. The hook ends are formed at terminal portions of the longer finger portions of the pivoted fingers, whereas permanent magnets are affixed to the short finger portions of the fingers, which are on the opposite side of the finger pivot point, relative to the long finger portions of the fingers.

The plastic card-key has the proper access code combination of spots of magnetic (magnetically permeable) material which causes all of the short legs of the first set of fingers to be attracted to the spots, to in turn pivot the entire first set of fingers to enable the release of the lock. Since the ratio of the length of the long finger portions over the length of the short finger portions is greater than unity, the hooks will move a relatively large distance away from the locking anchor members to effect the unambiguous unlatched condition, without potential manufacturing tolerance problems. In contrast, due to this lever configuration, movement of short leg portions will be through a shorter distance, which means that the plastic key card may be positioned very close to the permanent magnets to thus enable the use of slight amounts of suitable magnetic material in the key card to attract the magnets to actuate the fingers. Such a non-electrical lock is suitable for applications such as locks for apartments in an apartment building, where each card-key belonging to each tenant would bear a unique access code. Such a lock is also suitable for providing access to an area such as a parking lot for-example. In this case, a number of patrons authorized to use the parking lot would possess a card-key having a group access code which is common to all patrons, in contrast to the tenants, such access code being utilized to actuate a lock for opening a gate for example, to enable entrance into the parking lot.

It is deemed highly desirable to provide patrons with such card-keys having a common group access code. However, it would also be desirable to selectively lock out one or more bearers of the card-key in the event that they do not pay their parking lot fees. In the absence of the present invention, a patron would be able to retain the card and continue using the lot.

It is thus an object of the present invention to provide apparatus particularly useful in connection with the aforesaid Lovell Lock, which readily provides the operator of the parking lot with the capability of individually locking out selected patrons, regardless of whether they retain the card-key. In the apartment house application, each access code to the apartment would of course differ from access codes of other card-key bearers or tenants. However, one portion of the card-key could contain a lobby access code, common to all tenants for permitting entrance into the lobby. In this case we may wish to lock out a previous tenant from the lobby, and the improved lock of the present invention may be utilized to perform this function.

SUMMARY OF PREFERRED EMBODIMENTS OF THE INVENTION

In accordance with the present invention, a non-electrical lock is provided, having latching elements responsive to a group access code recorded on a plurality of cards issued to bearers. Each card-key of the bearers also carries a lockout code which is unique to each bearer in contrast with the group access code, and preferably consist of a single magnetic element upon a given position within a lockout code area upon the card, separate from the access code area. User lockout actuating means are provided having a group of individual magnetic members each selectively adjustable to place the members in an active or an inactive state. Actuation of the actuating means is required to prevent the patron from being locked out. Upon the initial condition of the lock, all of the magnetic members are positioned to assume the active state, so that a magnetic member in any one of a substantial number of positions will be actuated by the single spot of magnetic material positioned within various portions of the lockout code areas upon the card-keys. Each bearer of the card has a magnetic spot within the lockout code area uniquely positioned and capable of moving the lockout means to open the lock upon being aligned with an associated magnetic member of the lockout means actuating means assuming the active state and aligned with the card-key magnetic spot. A patron is later locked out by causing that lockout code responsive magnetized member positioned upon the lockout actuation means to be selectively adjusted to place such member in an inactive state, so that when the card-key of the bearer to be locked out is positioned within the lock, the lockout actuation means is no longer displaced and thus the lock will not open, regardless of the fact that the locked out patron positions the card-key having the proper group access code within the lock.

Although the preferred card-key employs a single magnetic spot upon a particular unique position within the lockout code area of each card-key, the insertion of a strip of magnetic material into the lockout code sensing area by a locked out patron would still operate the above described lock, since other selectively adjustable magnetic members for sensing magnetic spots of other non-locked out patrons would be in an active state. The present invention provides a countermeasure to such a technique, since a particular protected area portion of the lockout code upon the card-keys of all patrons will never have a magnetic spot thereon, and a movable protection means is provided for sensing the presence of magnetic material in this area. Should an unauthorized strip of magnetic material such as steel be inserted into the lock, the sensing of the magnetic strip in the protection area will produce motion of a movable protection latch to maintain the lock in the closed position. The lockout code area upon the card-keys is preferably defined by two rows which co-act with rotatable magnetic members having two magnets thereon angularly separated from each other, such that the rotatable elements may be rotated to the inactive state to quickly and easily provide lockout by withdrawing the magnets away from the card-keys.

Other objects, features and advantages of the present invention will become apparent upon study of the following specific description taken in conjunction with the drawings in which.

Figure 7:
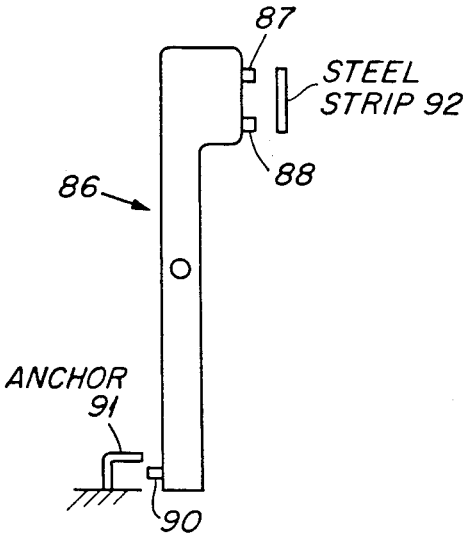

FIG. 7 further illustrates the protection member; and

Figure 8:
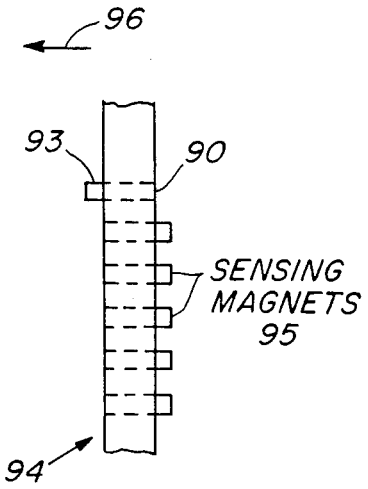

FIG. 8 illustrates another embodiment of a portion of the lockout actuation means.

DETAILED DESCRIPTION

Figure 1:
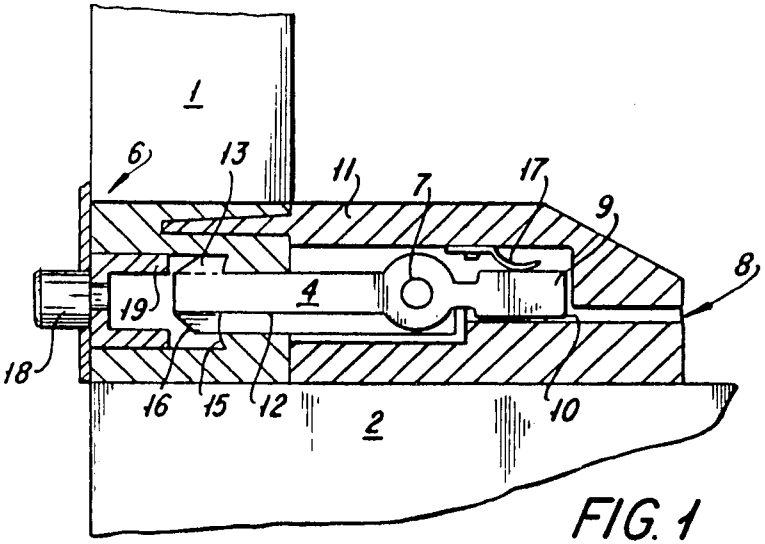
FIGS. 1–3 show embodiments of the Lovell lock useful in connection with the present invention.

In FIG. 1 a first embodiment of the above mentioned Lovell lock is illustrated, wherein a door 1 is positioned adjacent its frame 2. Frame portion 6 includes a bank of elongated latching fingers 4 which are pivotably mounted upon pivot pin 7. A key card insert slot 8 is configured to receive a key card so that the code actuating portion of the card will be positioned adjacent the short finger portion 9 of finger 6. At the terminal portion of the longer finger portion, a hook member is formed upon the finger which engages anchor member 11, rigidly affixed to door 1. The lock preferably includes a plurality of pivoted latching fingers which are actuated in the manner of the keys of a piano, and if the proper combination of fingers is actuated, all of the hook portions will clear the anchor member 11 and the door may thus be opened.

Now let it be assumed that a key card is inserted within slot 8 which has the proper combination of "bumps" or raised actuating portions. Certain of the latching fingers will be actuated, and their hook ends 13 will clear the shoulders of anchor member 11. These latching fingers comprise a first set having their hooks facing upwardly as indicated by hook 13. Other latching fingers which should be actuated in accordance with the proper combination, will also have their corresponding upwardly facing hook members moved downwardly due to the interaction between the card "bumps" and their short finger portions similar to 9. However, should one or more of the latching fingers which should not be actuated become actuated, their downwardly facing hook members such as 16 (affixed to a latching member behind the member in the plane of the drawing) will become engaged with the shoulder of the lower anchor member 15, to prevent the lock from opening.

Thus in accordance with the illustrated embodiment of the Lovell lock, a first set of latching fingers having hook members extending upwardly, is interleaved with a second set of latching fingers having their hook ends extending in a direction 180° opposite to the direction of orientation of the hook members of the first set. Thus the improper actuation of a latching finger will cause its downwardly extending hook member such as 16 to be downwardly displaced to maintain the latched condition, and furhermore the insertion of a tool into slot 8 to indiscriminately actuate fingers, will cause an actuated finger having a downwardly facing hook 16 to engage the lower anchor member to prevent the lock from opening. The insertion of the card having the proper placement of "bumps", will cause all hook members of all pivoted latching fingers to clear the shoulders of both the upper anchor member and the lower anchor member and door 1 may be opened. A leaf spring 17 may be advantageously provided to mechanically bias the shorter finger portion downwardly.

The door preferably has a conventional door knob, so that when all of the hooks have cleared the anchor means, the owner of the inserted card-key presses against the door knob (or the door if there is no knob) to enable door 1 to be displaced to the left in FIG. 1. When the card-key holder has entered the premises he closes the door to cause the hook ends to again actuate the lock by being locked into the anchor means (at 15), just after the hooks assume neutral positions as the door is being closed, due to the tapered portions 13 and 16 contacting the right hand portion of member 6. When the card-key holder wishes to leave the locked premises, he actuates button 18 to in turn displace slide member 19 to the right to cause the hook ends to again assume the neutral position, enabling the holder to pull the door knob, or a projection upon the door if there is no knob, which will enable the door with the anchor members to clear the neutrally positioned hook ends. Finger support member 10 maintains the proper positioning of finger portion 9 within slot 8.

Figure 2:
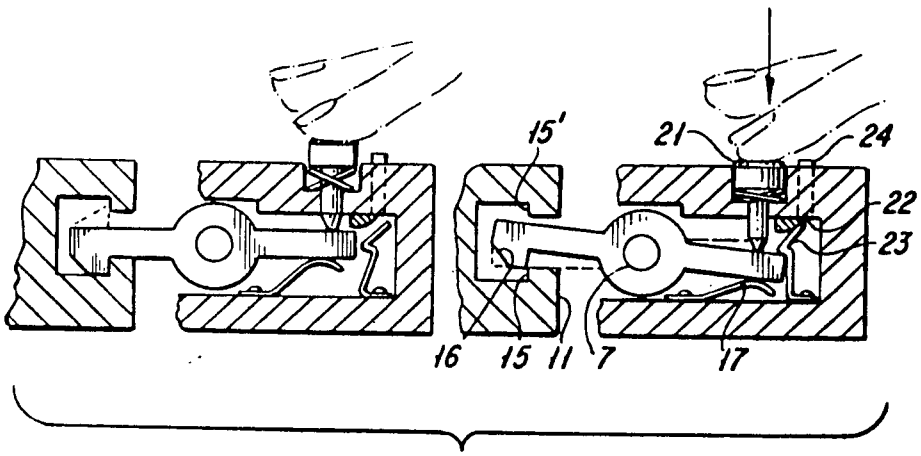

In FIG. 2, a second embodiment of the Lovell lock is illustrated whereby push button finger actuating means 21 may be actuated to cause clockwise pivoting of the latching finger about pivot member 7 to in turn cause hook member 16 to clear the shoulder 15 of anchor member 11. The push button operates against the counter pressure of leaf spring 17. As before, the improper actuation of a single latching finger having an upwardly facing hook member rather than a hook member oriented as illustrated, will cause such normally disengaged hook member to engage the upper shoulder 15, of anchor 11. A holding latch finger spring 22 is illustrated which will maintain actuated fingers in the downward direction due to the ledge 23 formed therein. If an improper combination is actuated, a lock reset bar 24 is pushed to cause the upper portion of latching spring 22 to be displayed to the right, thereby to enable the counter clockwise rotation of the latching fingers under the influence of spring 17. This arrangement eliminates the requirement that the fingers of the operator remain positioned against the buttons up until the time of opening the door.

Figure 3:
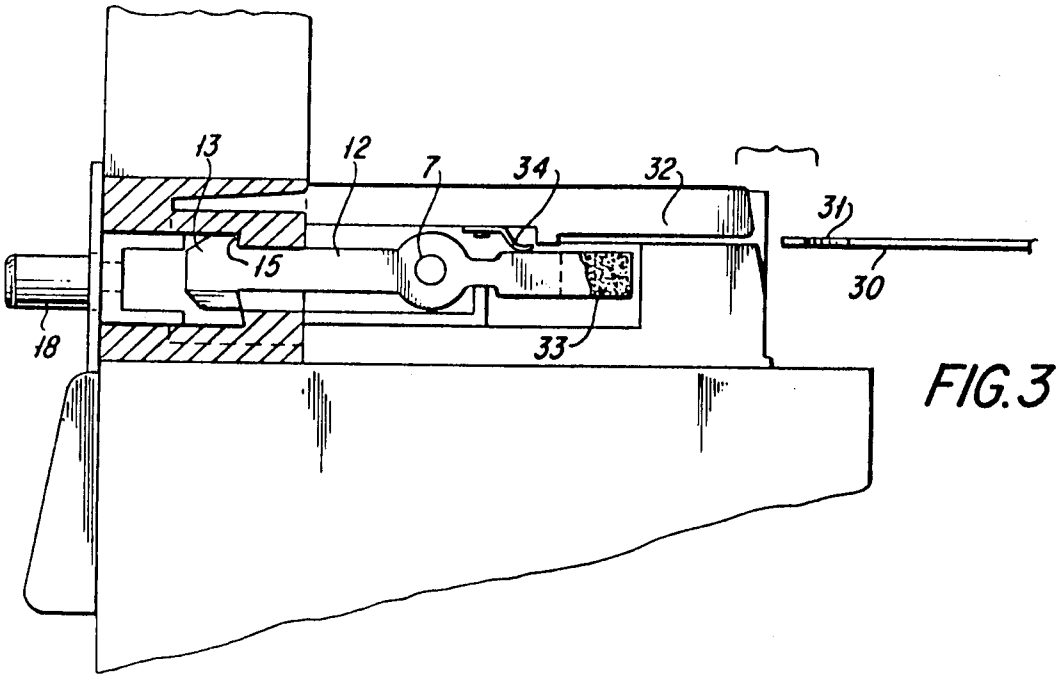

In FIG. 3, a magnetically actuated embodiment of the Lovell lock is illustrated, having certain components corresponding to those decscribed in FIG. 1. A card key 30 which could of course also comprise an identification card, has a plurality of ferro-magnetic inserts formed across the width of the card at selected positions, which manifests the combination of the lock. It is an important aspect of this embodiment that the magnetic material in the card not be permanently magnetized to produce large quantities of flux, because a card key having permannnt magnets therein could erase magnetically recorded data in other credit cards or the like in the users wallet.

Slot 32 is configured to receive the key card 30 positioned so that the spots of magnetic material 31 will become aligned with permanent magnets 33 which are affixed to the short finger portions. It is an important aspect of this embodiment of the Lovell lock, that the magnetic material 31 be positoned very close to the short leg of the latching finger so that the relatively slight mass of material formed within the thin card is able to cause counter clockwise rotation of the latching fingers through a small angle. If larger displacements of the finger portions would be required, as in the prior art, the resulting air gap and magnetic reluctance would be great, and a far greater amount of magnetic material would have to be formed in the key card, which is impractical since such cards would have considerable thickness.

It is a further important aspect of the Lovell lock that the finger portions bearing the hook members preferably be relatively long, or at least longer than the portions bearing the magnets, so that displacement of the hook members is through a greater distance relative to the relatively small displacement of the magnet portions of the fingers, thereby to reduce possible manufacturing tolerance problems mentioned earlier. Also the separation of the magnetic material at one terminal portion of the finger from the hook member material at the other is significant, since the hook member should have different metallurgical characteristics than the magnet portions.

Let it be assumed that the latching finger having the downwardly extending hook 16 should not be actuated and upwardly extending hook 13 should be actuated. In this case a magnetic spot would be positioned on the card aligned with the finger in the plane of the drawing and counter clockwise rotation of the latching finger would cause hook member 13 to be released from the upper anchor member whereas a "no spot" condition at the adjacent finger would maintain the hook member 16 of the second finger in the disengaged position as shown in the drawing. Should a magnetic spot be present however, counter clockwise rotation of the second latching finger would cause normally disengaged hook 16 to engage the lower portion of the anchor member and the lock would not open.

Thus in summary, all of the fingers of a first finger set to be actuated in accordance with a proper combination must be actuated, and if any fingers are actuated in the second set of fingers interleaved with the first set, the normally disengaged hook members such as 16 will become engaged, thereby to inhibit the opening of the lock. As before, the lock is opened from the inside by actuating button 18, to cause the pivotable latching fingers to move toward each other to in turn maintain the hook members in the disengaged position with respect to the anchor members.

Figure 4:
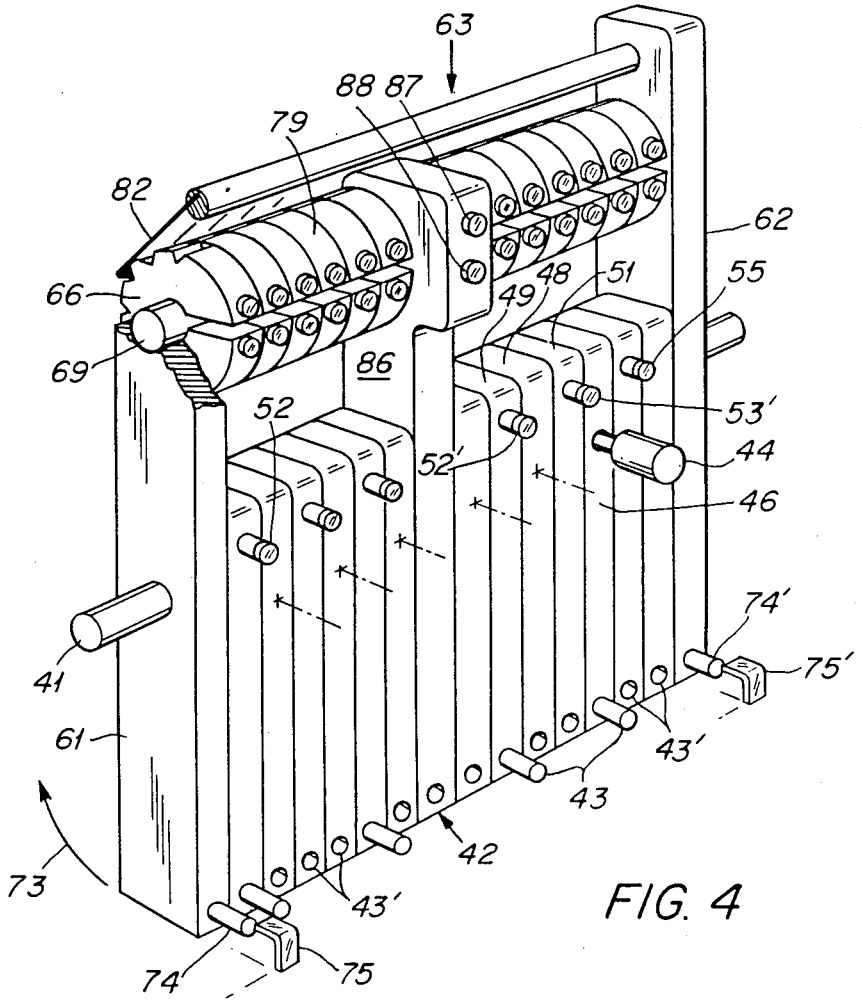
FIG. 4 illustrates a presently preferred embodiment of the invention.

The apparatus described in FIGS. 4, 5, 6, and 7 comprises structure embodying the invention which is preferably integrated with the above described structure. FIG. 4 illustrates a pivot pin 41 which pivotably supports the above mentioned fingers 42, such fingers being pivotable about pivot pin 41. The illustrated cylindrical hook members 43, are positioned on the lower terminal portions of the pivoted fingers 42, which face the first anchor means previously described, and the remaining hooks which are not shown in FIG. 4, face the second anchor means positioned in back of the apparatus, as previously described. Thus all fingers would be biased in the manner previously described in connection with biasing spring 17 of FIG. 2, so that hooks 43 would be biased against the first anchor means and hooks 43' extending out of the rear of the bank of fingers shown in FIG. 4 would be biased out of the second anchor means. This structure is not shown in the interest of clarity in FIG. 4. Push buttons such as push button device 44, would cause certain of the fingers to pivot about pivot pin 41. For example, 44 would actuate finger 46 and similar pushbutton devices would actuate other fingers. Fingers 49 and 51 bear cylindrical permanent magnet members 52 and 53, and in contrast with the pushbutton actuated finger 46, will be pivoted upon being attracted to access code magnetic code elements upon the card key, such elements being formed within row C of the card-key shown in FIG. 5. In like manner the attraction of magnets 52 and 52' toward magnetic material on the card would also release hooks 43 from the first anchor means. In contrast, should magnet 53' or 55 be attracted, the rearwardly facing hooks 43' would be pushed into the second anchor means, to lock the device as previously described in connection with the downwardly facing hooks shown in FIGS. 1 and 3. Thus a first and second set of fingers are provided, some of which are preferably actuated by pushbutton, and others of which are actuated by magnetic code elements in row C of the card-key 40 of FIG. 5. The row C code comprises an access code whereby the bearer of the card key is able to actuate the lock upon inserting the card key, whereby row C is aligned with the row of finger mounted, magnetic members comprising permanent magnets 52 and 53 shown in FIG. 4. The optional pushbutton code would be memorized by the bearer.

While the present invention may be practiced in numerous environments, let it be assumed that the card-keys are to unlock a parking lot gate. The patron is issued a card having the proper access code elements in row C, which will actuate the proper combination of fingers as described previously. Optionally he may also be instructed to push certain buttons, if they are provided in accordance with a memorized "password" or pattern. The same password and access codes are utilized by each patron.

Figures 6A, 6B, 6C, 6D:
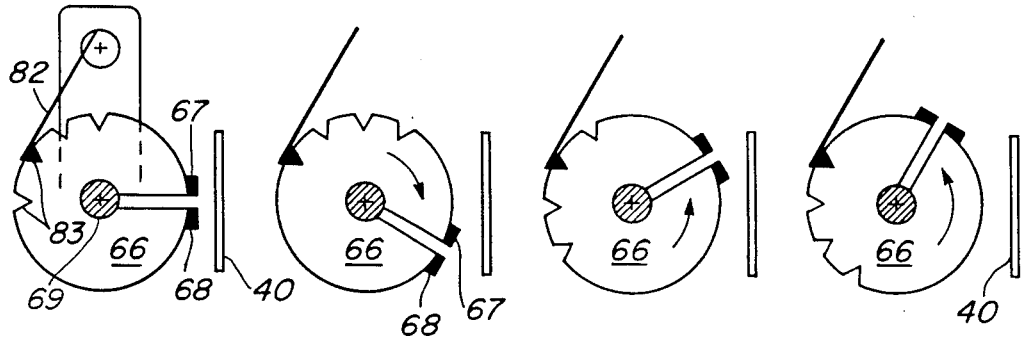
FIGS. 6A–6D illustrate a portion of the discs of FIG. 4.
Figure 5:
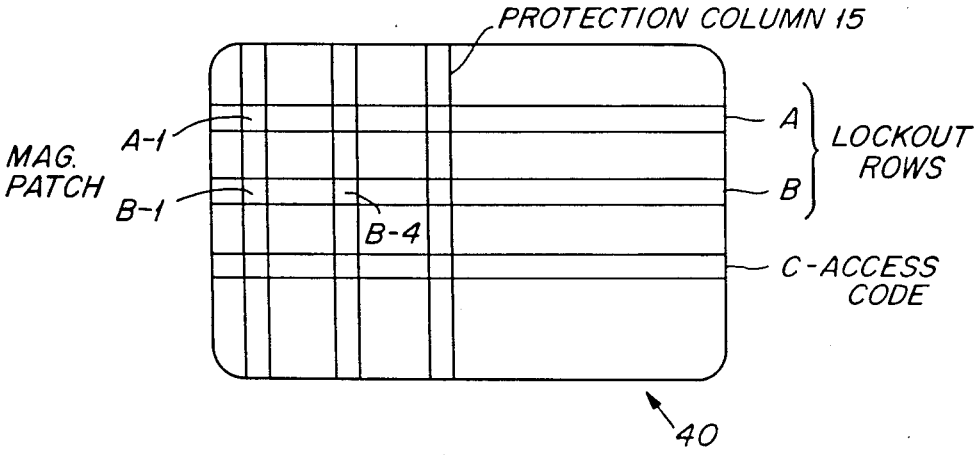
FIG. 5 shows a portion of a card-key used in connection with FIG. 4.

In accordance with the lockout method of the invention, it may be that certain patrons become delinquent in paying their monthly fees to the extent that the lot operator wishes to lock out the delinquent patron, even though he is in possession of the card-key and password. Thus in addition to row C which contains the door opening or access code combination, rows A and B are provided for the purpose of lockout. A given patron may have a single magnetic patch A-1 in the first column of row A of card-key 40 as indicated in FIG. 5. In this case, the lot operator could alter the lockout code sensors to be described so that the A-1 magnetic patch would no longer open the lock. The lockout means of the preferred embodiment comprises a pivotable frame having side portions 61 and 62, which frame is pivotably supported by pivot pin 41. The cross piece 63 joining the frame side portions 61 and 62 will rotatably support a plurality of disks such as disk 66 also illustrated in FIG. 6A. Disk 66, rotatable about cylindrical cross piece rod 69, has two discreet permanently magnetized magnetic members 67 and 68, positioned at outer portions thereof. In FIG. 6A both discreet magnetic members are aligned with rows A and B of FIG. 5 which comprise the lockout code rows on the card-key. Disk 66 is rotatable to cause the discreet magnetic members 67 and 68, to become aligned selectively with row A and/or row B, or none of them as illustrated in FIGS. 6A, 6B, 6C, and 6D.

Initially all disks of the lockout actuating means are positioned as shown in FIG. 6A so that any one magnetic element in rows A or B of the card-keys will attract the lockout means actuating means comprising the entire upper portion 63 of the lockout frame, to cause it to pivot about pivot 41. This action displaces lockout hooks 74 and 74' away from lockout anchor members 75 and 75' to enable the opening of the lock. Let it be assumed that a delinquent bearer of the card-key to be locked out has the Al magnetic patch illustrated in FIG. 5 within row A and no other magnetic material within any other positions in the lockout rows A and B of his card-key. In this case, the first disk 66 of FIG. 4 will be rotated by the lot operator as shown in FIG. 6B, so that the permanent magnetic member 67 is no longer positioned closely adjacent the first column of row A so that it can no longer sense the presence of the magnetic A-1 patch. As a result, the lockout frame would not be pivoted in the direction of arrow 73 because disk 66 is no longer attracted to the magnetic A-1 patch. Hook members 74 and 74' which are positioned upon the pivotable frame will no longer be displaced in the direction of arrow 73 in order to clear the lockout anchor members 75 and 75' facing the hooks to enable the opening of the lock as explained previously.

It may be noted however that all other disks illustrated which are utilized to sense magnetic patches in all of the other columns of the patrons card-key still assume the position shown in FIG. 6A. Furthermore, the patron having a card-key with a magnetic patch in the first column but in the B row rather than the A row will not be locked out because his magnetic patch will be aligned with element 67 as indicated in FIG. 6B. If we wish to lock him out also, the disk is rotated as indicated in FIG. 6D so that his B-1 magnetic patch will no longer attract a permanent magnet. Conversely, if we wish to lockout the patron having the B-1 magnetic patch rather than the A-1 patch, the disk is rotated as shown in FIG. 6C so that permanent magnetic member 68 will be attracted to the row A patch but not the row B-1 patch. FIG. 6D illustrates the position of the disk to lockout patrons having a magnetic patch in both row A and row B in the first column.

Detent reed spring 82 maintains the manually selected angular positions of each of the disks across the entire cross piece. A portion of reed spring means 82 is illustrated in FIGS. 6A through 6D and it may be seen that the spring 82 presses against detent grooves 83 formed in the periphery of disk 66. All sixteen of the disks are maintained in a selective position in a like manner across the width of the cross piece.

Summarizing FIGS. 6A through 6D, FIG. 6A illustrates the first column disk for sensing magnetic patches A-1 and B-1, shown in FIG. 5. All disks e.g., 16 of them, illustrated in FIG. 4, will initially assume the position in FIG. 6A when no patron is to be locked out, and accordingly a magnetic patch anywhere in rows A and B, except as explained hereafter, will cause a particular disk to be attracted to the card-key, thereby to rotate the lockout frame means in the direction of arrow 73 to cause lockout hooks 74 and 74' to clear anchor means 75 and 75'. Should we wish to lockout the card bearer having the A-1 magnetic patch, the parking lot operator rotates the first disk 66 to cause it to assume the position shown in FIG. 6B so that the A-1 patch is now ineffective to rotate the lockout frame to enable the lock to be opened. Conversely if we wish to lock out that card-key bearer having a magnetic patch B-1 in the first column, the first disk 66 is rotated to assume the position shown in FIG. 6C. If we wish to lock out both of these patrons, the disk would assume the position shown in FIG. 6D. Other card-key bearers having magnetic patches in other columns would be locked out in like manner. If for example, if we wish to lockout that card-key bearer having a magnetic patch in the fourth column of the B row, namely the B-4 patch illustrated in FIG. 5, the fourth disk 79 would assume the position shown in FIG. 6C. It should be noted however that since permanent magnetic member 68 is still adjacent the card-key in the position shown in FIG. 6C that the card-key bearer having an A-4 patch, that is a magnetic patch in the fourth column of the A row, will still have access to the parking lot since magnetic member 68 is still adjacent to the A row.

Thus it should now be appreciated that a lockout means comprising, preferably, a pivoted frame having lockout hooks 74 and 74' at terminal portions thereof, is provided, which if the lockout means is not actuated the lock cannot be opened due to 75 and 75'. The lockout means actuation means is mounted upon the lockout frame and comprises a plurality of rotatable disks, in the preferred embodiment, having permanent magnetic elements which assume active or inactive states with respect to magnetic patches formed upon the lockout rows A and B of the card-keys issued to the users of the parking lot.

Each issued card key has magnet spots or elements which consist of magnetically permeable material such as iron powder and graphite described in further detail in co-pending patent application No. 639,270, filed 8/9/84 and assigned to Avant Incorporated. Thus a thin, light flexible card may be employed, since permanent magnets need not be employed in the card, such permanent members being employed in the locking device, e.g. elements 67 and 68. Also there are no active magnets in the users wallets to distort any magnetic stripe encoded cards in the wallet.

In accordance with a further feature of the invention, apparatus is provided for protecting the lockout device against the insertion of an elongated magnetically permeable strip of, for example, iron or steel by the locked out patron. If such an elongated strip was inserted so as to overlay the magnets of the disks, one or more of the disk magnets would be attracted to the iron strip, and the lockout device would be actuated by this unauthorized procedure. This technique is foiled by providing a protection member preferably pivotably coupled to the pivot pin 41, for disabling the opening of the lock upon being actuated by the iron strip. In the preferred embodiment, a centrally located pivotable elongated member or finger 86 is shown in FIG. 4, pivoted about pivot pin 41, and bears permanent magnet members 87 and 88 which are aligned with rows A and B of the card. In the example, it may be seen that the protection finger 86 is aligned with central protection column 15 of the encoding area of the card key of FIG. 5. The unauthorized insertion of an elongated iron strip will cause pivot member 86 to rotate about pivot pin 41, and the hook thereof will engage a protection anchor means positioned in back of the apparatus of FIG. 4, thereby to prevent the opening of the lock, regardless of the rotation of the locking frame member about the pivot pin 41 due to the insertion of the strip. Protection column 15 of all issued card-keys will *never have magnetic material therein* in rows A and B, so that the presence of magnetic material in column 15 will indicate the unauthorized use of an elongated iron strip or the like. In FIG. 7, protection finger 86 is further illustrated, having hook 90 engaging the protection anchor means 91, to prevent the lock from opening upon the presence of steel strip 92.

For certain applications such as parking lot environments, it may be economical to eliminate the common access code and the pivoted fingers such as 48, 49, and 51, and optionally substitute elongated magnets 95, shown in FIG. 8, for the rotatable disks, so that the entrance code becomes the placement of a single magnetic spot on one of, for example 6 lockout rows. In this case six slidably adjustable permanent magnet members 95 would be positioned within elongated, rectangular magnet support elements 94 (one for each column) which in turn are all affixed to the pivotable lockout frame, which of course includes side member 61 and 62 together with the lockout hooks 74 and 74'. The device of FIG. 8 would be duplicated for each column to be sensed by the lockout device so that 16 sets of six slidable permanent magnets 95 would be substituted for the 16 rotatable disks shown in FIG. 4. Should we wish to lockout the card bearer having a magnetic spot in the row A, column 1 position, for example, the top permanent magnet 93, shown in FIG. 8, would be slid to the left in the direction of arrow 96, so that the righthand portion 90 thereof is no longer adjacent the A-1 magnetic spot on the card and thus the bearer would be locked out. It should be noted that in this particular case, the entire lock comprises the lockout sensing means functioning in the absence of the combination code actuated fingers.

Other possible applications of the invention involve utilizing the lockout structure in connection with industrial areas or apartment buildings. It may be desirable to have the landlord have the capability of locking out a tenant upon the non-payment of rent, while at that the same time not permitting the landlord to open the lock, to insure the privacy of the tenant. Fo example the tenant may utilize the pushbuttons to actuate the fingers in accordance with the primary access code to gain entrance to his apartment. While this code is not available to the landlord, to ensure privacy, the landlord would have the capability of locking the tenant out in accordance with the procedure set forth above.

While preferred methods and embodiments have been described, it will be readily apparent to those skilled in the art that numerous equivalents may be provided to practice the invention, and thus the scope of the invention is to be defined only by the language of the following claims and art recognized equivalents thereof. For example, the term "card-key" is intended to cover any keying device having codes recorded thereon, and thus is not to be restricted to a planar card generally carried in the wallet of the bearer, although such a card is greatly preferred.

We claim:

1. In a combination locking device:

first and second anchor means;

first and second sets of movable latching elements having hooks at first portions thereof and magnets at second portions thereof widely separated from said first portions;

support means intermediate said first and second element portions for movably supporting said first set of latching elements for causing the hooks thereof to extend from said elements in a first direction toward said first anchor means to enable said hooks to interact therewith and for movably supporting said second set of latching elements for causing the hooks thereof to extend in a second direction opposite said first direction toward said second anchor means to enable said hooks to interact therewith;

latching element actuating means for actuating all of the elements of said first set and none of the elements of said second set in order to open said lock;

user lockout means having means for enabling the opening of said lock upon the actuation of said lockout means;

lockout means actuating means having a group of individually adjustable magnetic members, each positionable in an active position or an inactive position;

card key positioning means for positioning an unlocking card key having one or more magnetic elements thereon in lockout areas thereof capable of moving said lockout means upon being aligned with an associated magnetic member assuming said active position and aligned therewith.

2. The locking device set forth in claim 1 wherein said card key has a protection area thereof which never has a magnetic element therein, and further including protection means for disabling the opening of said lock upon the actuation thereof, and having a magnetic member aligned with said protection area of said card when said card is positioned in said positioning means.

3. The locking device set forth in claim 2 wherein said individually adjustable magnetic members each comprise a rotatable element.

4. The locking device set forth in claim 3 wherein each rotatable element has two magnets thereon angularly separated from each other.

5. The locking device set forth in claim 4 further including detent means for maintaining each rotatable element in a given angular position.

6. In a combination locking device:

first and second anchor means;

first and second sets of latching elements having hooks at first portions thereof and actuating means for actuating said elements at second portions thereof;

support means intermediate said first and second element portions for movably supporting said first set of latching elements for causing the hooks thereof to extend from said elements in a first direction toward said first anchor means to enable said hooks to interact therewith and for movably supporting said second set of latching elements for causing the hooks thereof to extend in a second direction opposite said first direction toward said second anchor means to enable said hooks to interact therewith;

mechanical biasing means for biasing said first set of elements in a biasing direction to cause the hooks thereof to be engaged with said first anchor means and for biasing said second set of elements in a biasing direction to cause the hooks thereof to be disengaged from said second anchor means;

latching element actuating means for actuating all of the elements of said first set and none of the elements of said second set in order to open said lock;

movable lockout means having a third set of latching elements for enabling the opening of said lock upon the displacement of said lockout means;

lockout means actuating means having a group of individually adjustable magnetic members, each positionable in an active position or an inactive position;

card-key positioning means for positioning an unlocking card-key having magnetic elements thereon in a first area thereof capable of operating said lockout means actuating means upon being aligned with an associated magnetic member thereof assuming said active position and aligned therewith with respect to said first area.

7. The locking device set forth in claim 6 wherein said card-key has a second area thereof which never has a magnetic element therein, and protection means for disabling the opening of said lock upon the actuation thereof, and having a magnetic member aligned with said second area of said card when said card is positioned in said positioning means.

8. The locking device set forth in claim 7 wherein said individually adjustable magnetic members each comprise a rotatable element.

9. The locking device set forth in claim 8 wherein each rotatable element has two magnets thereon angularly separated from each other.

10. A method of locking out a bearer of a card-key having magnetic coding elements positioned within a first portion thereof constituting a group access code for opening a locking device and having at least one magnetic coding element in a second portion thereof constituting an individual lockout code comprising the steps of:

providing the locking device as set forth in claim 6;

providing said bearer with said card-key; and thereafter optionally locking out said bearer by changing the state of at least one of said magnetic members of said lockout means actuating means to prevent opening of said locking device by said bearer, regardless of the retention of said card-key by said bearer.

11. In a combination locking device;

first and second anchor means;

first and second sets of pivotable latching elements having hooks at first portions thereof and magnets at second portions thereof widely separated from said first portions;

pivot means intermediate said first and second element portions for pivotably supporting said first set of latching elements for causing the hooks thereof to extend from said elements in a first direction toward said first anchor means to enable said hooks to interact therewith and for pivotably supporting said second set of latching elements for causing the hooks thereof to extend in a second direction opposite said first direction toward said second anchor means to enable said hooks to interact therewith;

mechanical biasing means for biasing said first set of elements in a biasing direction to cause the hooks thereof to be engaged with said first anchor means and for biasing said second set of elements in a biasing direction to cause the hooks thereof to be disengaged from said second anchor means;

latching element actutating means for actuating all of the elements of said first set and none of the elements of said second set in order to open said lock;

lockout frame means pivoted about said pivot means having at least one latching element for enabling the opening of said lock upon the rotation of said lockout frame means about said pivot means;

lockout frame actuating means having a group of individually adjustable magnetic members, each positionable in an active position or an inactive position;

card-key positioning means for positioning an unlocking card key having magnetic elements thereon in first areas thereof capable of pivoting said lockout frame means upon being aligned with an associated magnetic member upon said frame means assuming said active position and aligned therewith with respect to said first area.

12. The locking device set forth in claim 11 wherein said card key has a second area thereof which never has a magnetic element therein, and protection latching means pivotably coupled to said pivot means for disabling the opening of said lock upon the actuation thereof, and having a magnetic member aligned with said second area of said card when said card is positioned in said positioning means.

13. The locking device set forth in claim 12 wherein said individually adjustable magnetic members each comprise a rotatable element.

14. The locking device set forth in claim 13 wherein each rotatable element has two magnets thereon angularly separated from each other.

15. The locking device set forth in claim 14 further including detent means for maintaining each rotatable element in a given angular position.

16. In a locking device that opens in response to an access code and a separate lockout code, both codes recorded upon a card-key inserted therein;

first and second anchor means facing each other;

first and second sets of pivotable latching members having hooks at first portions thereof and magnets at second portions thereof widely separated from said first portions;

pivot means intermediate said first and second element portions for pivotably supporting said first set of latching elements for causing the hooks thereof to extend from said elements in a first direction toward said first anchor means to enable said hooks to interact therewith and for pivotably supporting said second set of latching elements for causing the hooks thereof to extend in a second direction opposite said first direction toward said second anchor means to enable said hooks to interact therewith;

latching element actuating means responsive to said access code upon said card-key for actuating all of the latching elements of said first set and none of the elements of said second set in order to open said lock;

user lockout frame means pivoted about said pivot means having latching means for enabling the opening of said lock upon the rotation of said lockout frame means about said pivot means;

user lockout frame actuating means having a group of individually adjustable magnetic members upon said lockout frame means, each positionable in an active position or an inactive position;

card-key positioning means for positioning an unlocking card key having one or more magnetic elements thereon in lockout areas thereof exclusive of said access code areas thereof, capable of moving said lockout frame means upon being aligned with an associated magnetic member of said lockout frame means assuming said active position and aligned therewith.

17. The locking device set forth in claim 16 wherein said card-key has a protection area thereof which never has a magnetic element therein, and movable protection means for disabling the opening of said lock upon the actuation thereof, and having a magnetic member aligned with said protection area of said card-key when said card-key is positioned in said positioning means.

18. The locking device set forth in claim 16 wherein said individually adjustable magnetic members each comprise a rotatable element.

19. The locking device set forth in claim 18 wherein each rotatable element has two magnets thereon angularly separated from each other.

20. The locking device set forth in claim 19 further including detent means for maintaining each rotatable element in a given angular position.

21. A method of selectively locking out bearers of card-keys for a locking device comprising a plurality of latching elements interacting with corresponding stationary anchor means, each card-key having coding elements positioned within a first portion thereof constituting a common access code which is the same for all card-keys for opening a locking device, and having coding elements in a second portion thereof constituting an individual lockout code unique to the card-key of each bearer, comprising the steps of:

providing said locking device with access code sensing means disposed on some of said latching elements for partially enabling the opening of said locking device upon the presence of a proper access code upon a card-key inserted therein and a plurality of magnetic lockout code sensing means disposed on other of said latching elements and initially separated from said card-key by a first distance small enough to enable a magnetic spot on said card-key to actuate said sensing means for fully enabling the opening of said locking device upon the presence of the lockout code upon said card-key;

providing each of said bearers with one of said card-keys for concurrent use in opening said lockout device; and thereafter optionally locking out selected prior bearers by increasing said distance between selected sensing elements of said lockout code sensing means but not said access code sensing means to prevent the opening of said locking device only by said selected prior bearers but not all prior bearers.

* * * * *